United States Patent [19]

Richardson

[11] 4,190,004

[45] Feb. 26, 1980

[54] TRANSACTION DRAWER

[75] Inventor: Daniel E. Richardson, St. Louis County, Mo.

[73] Assignee: Shure Manufacturing Corporation, St. Louis, Mo.

[21] Appl. No.: 944,754

[22] Filed: Sep. 22, 1978

[51] Int. Cl.[2] ..... E05G 7/00

[52] U.S. Cl. ..... 109/19; 232/44

[58] Field of Search ..... 109/10, 11, 19, 66; 232/43.1, 44

[56] References Cited

U.S. PATENT DOCUMENTS

| | | | |
|---|---|---|---|
| 451,317 | 4/1891 | Carman | 109/19 |
| 2,223,169 | 11/1940 | Ellithorpe | 109/19 |
| 3,059,840 | 10/1962 | Graber et al. | 232/44 |
| 3,145,918 | 8/1964 | Higgins et al. | 109/19 X |
| 4,084,518 | 4/1978 | Carlson | 109/19 |

*Primary Examiner*—David H. Corbin

*Attorney, Agent, or Firm*—John D. Pope, III

[57] ABSTRACT

A transaction drawer assembly is provided for use in carrying out transactions through the wall of a building. The drawer assembly fits onto an opening in a building wall and attaches to provide an entry through which transactions can be carried out. The drawer accepts items brought to the building and delivers items outside the building so they can be removed therefrom.

5 Claims, 8 Drawing Figures

TRANSACTION DRAWER

The present invention relates to a transaction drawer assembly and more particularly to an assembly for carrying out transactions with dispatch and safety.

There are many circumstances where a business wishes to transact business while protecting its personnel and yet accommodating customers. These include driveup windows of many types and utilize various types of expediencies for accepting money or goods from a customer and delivering money or goods to a customer. An important factor is always to enable the transaction to be smoothly carried out while at the same time safeguarding the business participants.

Among the several objects of the present invention may be noted the provision of a transaction drawer assembly which fits numerous size openings in a building and is effective with buildings of varying wall thicknesses; and the provision of a transaction drawer assembly which does not add to the maintenance costs of building maintenance when it is installed and which does not disfigure the outer building surface. Other objects and features will be in part apparent and in part pointed out hereinafter.

The invention accordingly comprises the constructions hereinafter described, the scope of the invention being indicated in the following claims.

In the accompanying drawings, in which several of various possible embodiments of the invention are illustrated, FIG. 1 is a perspective view of the drawer assembly of the present invention in its closed position in which the drawer is entirely in the building;

Corresponding reference characters indicate corresponding parts throughout the several views of the drawings.

Figure 1:
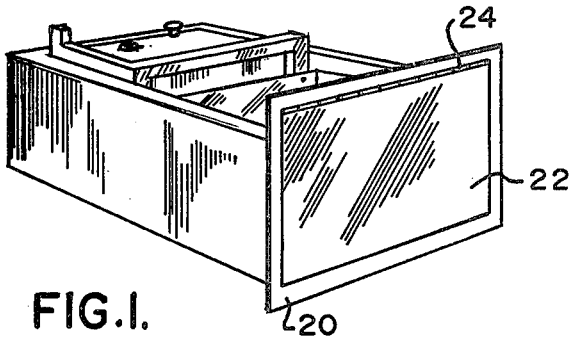
Figure 2:
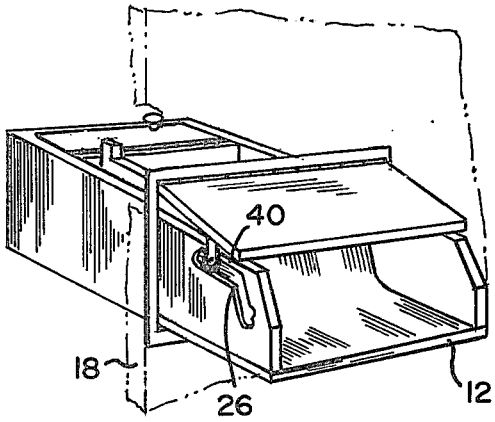
FIG. 2 is a view similar to FIG. 1 but with the drawer extended outside the building.
Figure 3:
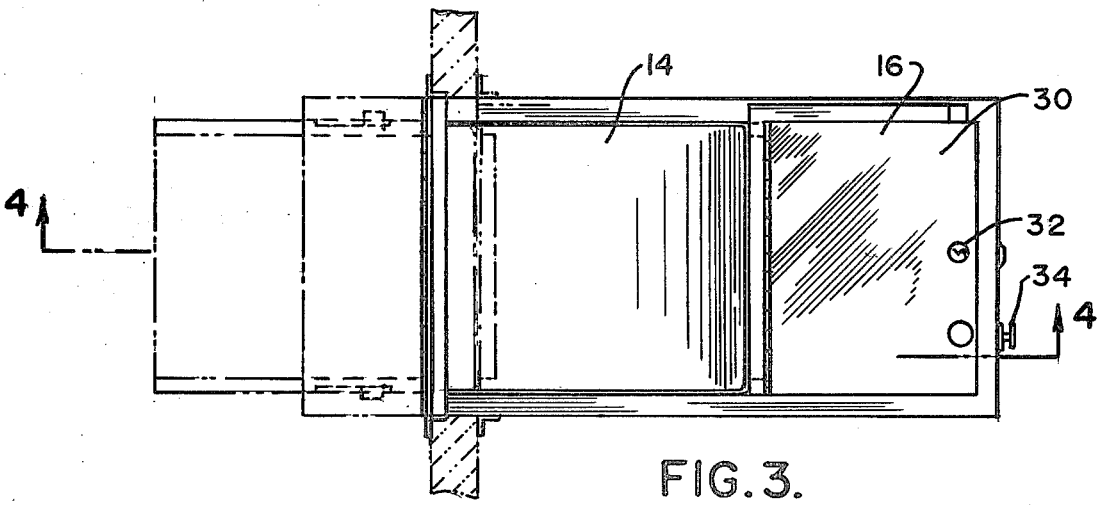
FIG. 3 is a top plan of the drawer of the present invention.
Figure 4:
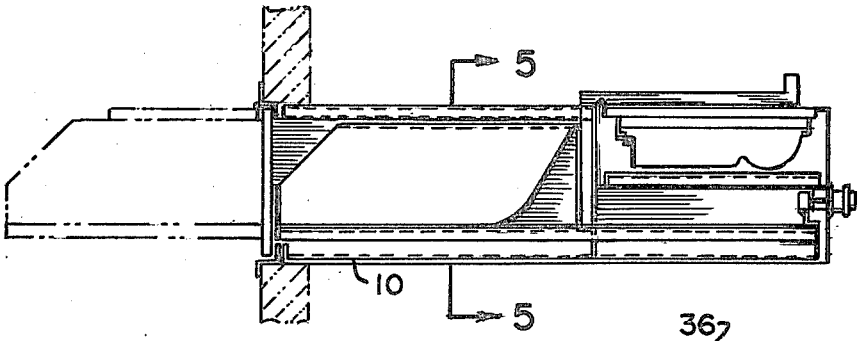
FIG. 4 is a section taken on the line 4—4 in FIG. 3.
Figure 6:
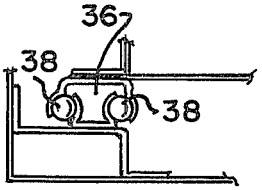
FIG. 6 is a section on an enlarged scale taken on the line 6—6 in FIG. 5.
Figure 5:
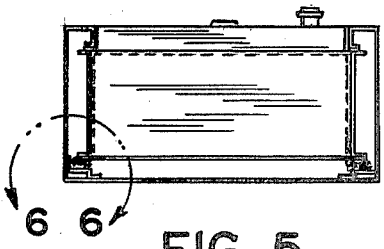
FIG. 5 is a section taken on the line 5—5 in FIG. 4.

The drawer assembly of the present invention includes a frame 10 which supports a drawer 12. Drawer 12 is divided into a plurality of compartments such as 14 and 16 for convenience of carrying out business transactions. Frame 10 is attached to the interior of a building wall 18 adjacent an opening therein which is framed by the frame 20 which is part of the assembly. Frame 20 supports a door panel 22 from hinges 24. Door panel 22 swings upward on hinges 24 when drawer 12 is projected forward. Drawer 12 carries a cam ledge 26 and door 22 carries cam follower roller 28 which cooperate to raise door 22 as drawer 12 is pushed forward. A ledge 26 and roller 28 are on each side of the drawer 12 and door 22.

Compartment 14 is sufficiently large so that goods to be delivered by the merchant fit comfortably therein. For example, a service station may have a compartment of the proper size to receive one or more cans of oil so that these can be dispatched through the mechanism to a customer. Compartment 16 may be utilized as a storage area for coins and bills which are received from customers or which are utilized in making change as part of the transaction. In such instances, a lid 30 forms a protective closure secured by one or more locks 32 and 34. This serves to protect the contents when not in use.

A guide 36 is part of the frame work and this guide provides a channel for the drawer to slide back and forth easily. To facilitate this, roller bearings 38 facilitate movement of the drawer and enable it to be smoothly advanced or retracted.

Since door 22, in effect, provides a continuation of wall 18, the drawer and associated mechanism is protected from the weather when not in use. As a result of this, the exterior configuration of the building is not injured and measures are not needed to protect all or part of the mechanism from weather influences.

The cooperation of cam ledge 26 and roller 28 raise panel 22 concurrently with advancing the drawer outside of the building and the interlock area 40 not only maintains smooth operation of the cam but also prevents forcing of the door beyond its intended arc and thereby injury to or immobilization of the entire mechanism.

Figure 7:
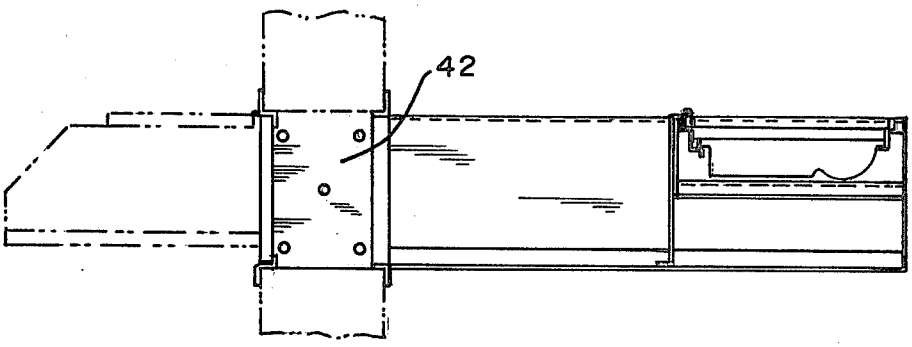
Figure 8:
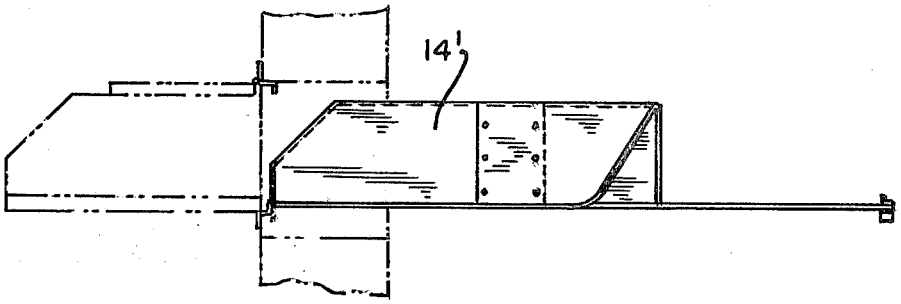

The drawer assembly of the present invention is useful for walls of many thicknesses. As shown in FIGS. 7 and 8, where the wall is of substantial thickness, a plate 42 on each side of the opening provides a support for the drawer frame work and also accomodates a larger forward compartment 14'. This enables the drawer to project the preferred distance from the wall opening to accommodate the desired transaction.

The drawer assembly may be made of different sizes and configurations to suit different types of business transactions. In all instances, however, it is entirely located within the building when not in use. Movement of the drawer to project part of it simultaneously moves a shield away from the wall opening to which the drawer assembly is mounted.

The drawer assembly of the present invention is well suited for use with driveup windows of the usual construction.

In view of the above, it will seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A transaction drawer assembly for use in carrying out transactions through the wall of a building comprising a drawer framework, means for mounting said framework to an opening in the wall, a runway projecting into said building as part of the frame work to support a drawer for movement along the runway, rotatable means on the drawer to cooperate with said runway to facilitate movement of said drawer through the opening in the wall to, in part, project outside said wall, a panel at the end of the framework which is mounted to the opening in the wall, which panel is hinged to the framework at its top so that it closes the opening in the wall and is parallel to the wall and contiguous thereto when in closed position, a cam surface attached to a side of the drawer adjacent the end of said drawer which is adjacent the panel when the drawer is in said framework in closed position, cam follower means attached to the panel in a location to cooperate with said cam surface to move the panel out of alignment with the wall when the drawer is moved through said opening so that it projects through the wall.

2. A transaction drawer assembly according to claim 1 in which the cam follower is a roller.

3. A transaction drawer assembly according to claim 1 in which the drawer is divided into a plurality of compartments only part of which project outside the wall when the drawer is in its fully extended position.

4. A transaction drawer assembly according to claim 3 in which one of the compartments projects substantially completely outside the wall when the drawer is in its fully extended position.

5. A transaction drawer assembly according to claim 4 in which the compartment which projects outside the wall when the drawer is in its extended position is sized to accomodate merchandise to be delivered to a customer.

* * * * *